US009039479B1

(12) United States Patent
Green

(10) Patent No.: US 9,039,479 B1
(45) Date of Patent: May 26, 2015

(54) WATER DISC TOY

(76) Inventor: Dakota I. Green, Claremore, OK (US)

( * ) Notice: Subject to any disclaimer, the term of this patent is extended or adjusted under 35 U.S.C. 154(b) by 228 days.

(21) Appl. No.: 13/313,727

(22) Filed: Dec. 7, 2011

(51) Int. Cl.
*A63H 27/00* (2006.01)
*A63H 33/18* (2006.01)
*A63H 33/26* (2006.01)

(52) U.S. Cl.
CPC ..... *A63H 33/18* (2013.01); *A63H 33/26* (2013.01)

(58) Field of Classification Search
CPC ..... A63H 33/18; A63H 33/185; A63H 33/22; A63H 33/26
USPC ..... 446/46, 47; 273/241
See application file for complete search history.

(56) References Cited

U.S. PATENT DOCUMENTS 3,167,799 A * 2/1965 McKinley ..... 15/176.4
4,038,914 A * 8/1977 Crespo et al. ..... 99/279
4,084,735 A * 4/1978 Kappas ..... 224/328
4,134,229 A * 1/1979 Lehman ..... 446/47
4,168,023 A * 9/1979 Osborn ..... 224/325
4,182,073 A * 1/1980 Tabet ..... 446/46
4,228,616 A * 10/1980 Wilson ..... 446/439
4,760,763 A * 8/1988 Trick et al. ..... 81/3.09
5,100,356 A * 3/1992 Atwell ..... 446/48
5,173,070 A * 12/1992 Gould ..... 446/79
5,277,641 A * 1/1994 Gable et al. ..... 446/46
5,351,967 A * 10/1994 Yang ..... 273/348.2
6,647,564 B1 * 11/2003 Smith ..... 4/606
6,783,421 B1 * 8/2004 Lopez ..... 446/153

* cited by examiner

*Primary Examiner* — Vishu Mendiratta
(74) *Attorney, Agent, or Firm* — Robert C. Montgomery; Montgomery Patent & Design

(57) ABSTRACT

A water disc toy comprises an upper platter, a lower platter, and a plurality of supports. Both the upper platter and the lower platter comprise a plastic structure with a flat or even slightly convex outer surface which facilitates skipping the device across a water surface. The upper and lower platter are interconnected with the plurality of integral supports. Each support comprises a small cylindrical plastic structure. The area between the upper platter, the lower platter, and the supports is filled with a lightweight foam material which allows the entire device to float in water.

14 Claims, 7 Drawing Sheets

WATER DISC TOY

RELATED APPLICATIONS

There are currently no applications co-pending with the present application.

FIELD OF THE INVENTION

The present invention relates generally to water throwing toys, and in particular, to a disc toy for skipping across water.

BACKGROUND OF THE INVENTION

Many toys for use in water or bodies of water are known. Rocks are used for skipping, but do not offer buoyancy. Frisbees are effective for passing between users in the air. Disc toys which skip across the water create an amusing game for various people. Various disc toys are known and while these water disc toys are effective, they offer little amusement to the user.

Various attempts have been made to provide a water skipping toy. Examples of these attempts can be seen by reference to several U.S. patents. U.S. Patent No. 2007/0,099,535, issued in the name of Riebersal et al., describes a water disc toy for skipping across water having a convex shape.

U.S. Pat. No. 5,540,610, issued in the name of Sneddon, describes a fluid carrying flying disc toy.

U.S. Pat. No. 5,679,082, issued in the name of Hincke, describes a saucer-shaped water skipping toy.

Additionally, ornamental designs for an aerial toy exist, particularly U.S. Pat. Nos. Des. 323,000. However, none of these designs are similar to the present invention.

While these devices fulfill their respective, particular objectives, each of these references suffer from one (1) or more disadvantages. Accordingly, there exists a need for a water disc toy without the disadvantages as described above. The development of the present invention substantially departs from the conventional solutions and in doing so fulfills this need.

SUMMARY OF THE INVENTION

The inventor has recognized the aforementioned inherent problems and lack in the art and observed that there is a need for a water disc toy.

Accordingly, it is an object of the present embodiments of the invention to solve at least one (1) of these problems. The inventor has addressed this need by developing a water disc toy which skips in water and provides amusement to the users.

To achieve the above objectives, it is an object of the present invention to provide a manually propelled disc toy.

Another object of the present invention is to provide a buoyant top half and a buoyant removably fastened bottom half.

Yet still another object of the present invention is to provide a plurality of columns fixed to the top half and fastened to the bottom half.

Yet still another object of the present invention is to provide an alternate bottom half.

Yet still another object of the present invention is to provide the alternate bottom half with light sources to illuminate the water disc.

Yet still another object of the present invention is to provide an alternate bottom half with a battery to power the light sources.

Yet still another object of the present invention is to provide an alternate bottom half with a battery compartment to house the battery.

Yet still another object of the present invention is to provide an alternate bottom half with a switch to control the light sources.

Yet still another object of the present invention is to provide a method of utilizing the device that provides a unique means of attaching the bottom half from the top half, throwing the water disc toy in a fashion which skips across water, removing the bottom half from the top half via detaching the columns, or utilizing the alternate bottom half to illuminate the light sources.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings in which like elements are identified with like symbols and in which:

DESCRIPTIVE KEY

Figure 1:
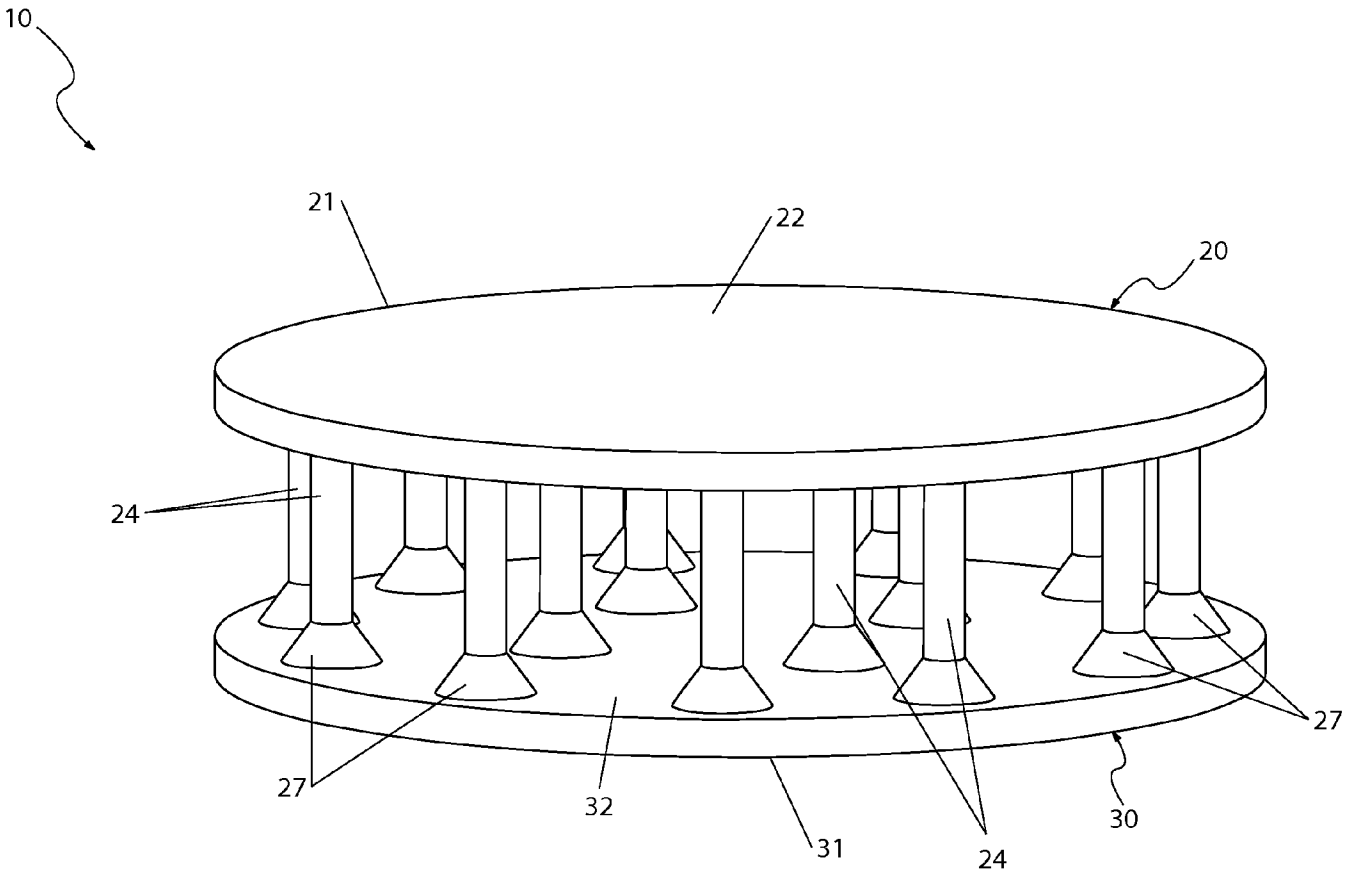
FIG. 1 is a perspective top view of a water disc toy 10, according to a preferred embodiment.

10 water disc toy
20 top half
21 top disc
22 top shell
24 column
27 column fastener
30 bottom half
31 bottom disc
32 bottom shell
33 foam core
34 battery cover
35 cover fastener
36 sealing member
37 battery compartment
38 transparent or translucent surface
39 switch
40 battery
42 light source
47 electrical wiring

50 alternate bottom half
51 alternate bottom disc
52 alternate bottom shell
53 alternate foam core

DETAILED DESCRIPTION OF THE PREFERRED EMBODIMENT

Figure 2:
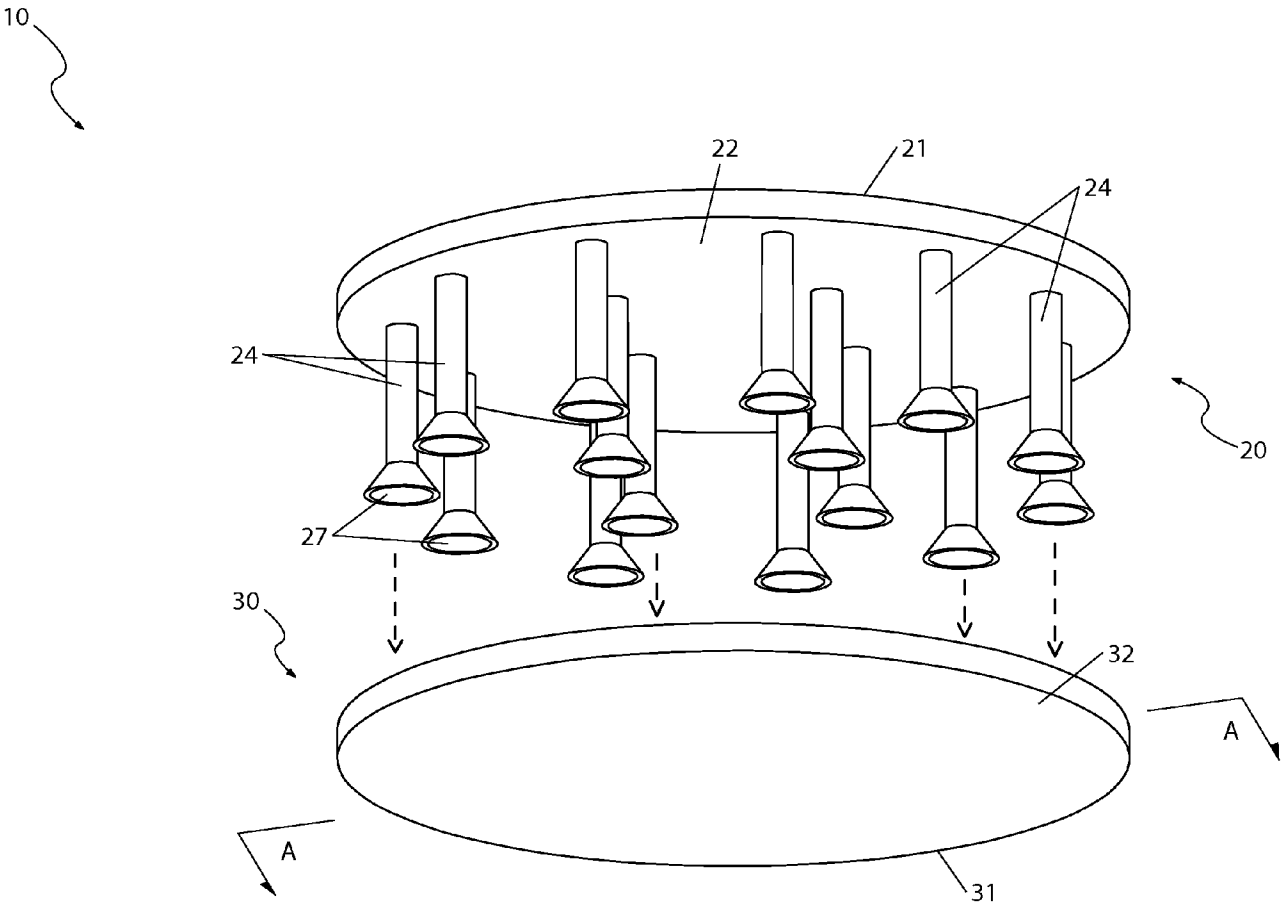
FIG. 2 is a perspective bottom view of the water disc toy 10 depicting a top half 20 separated from a bottom half 30, according to the preferred embodiment.
Figure 3:
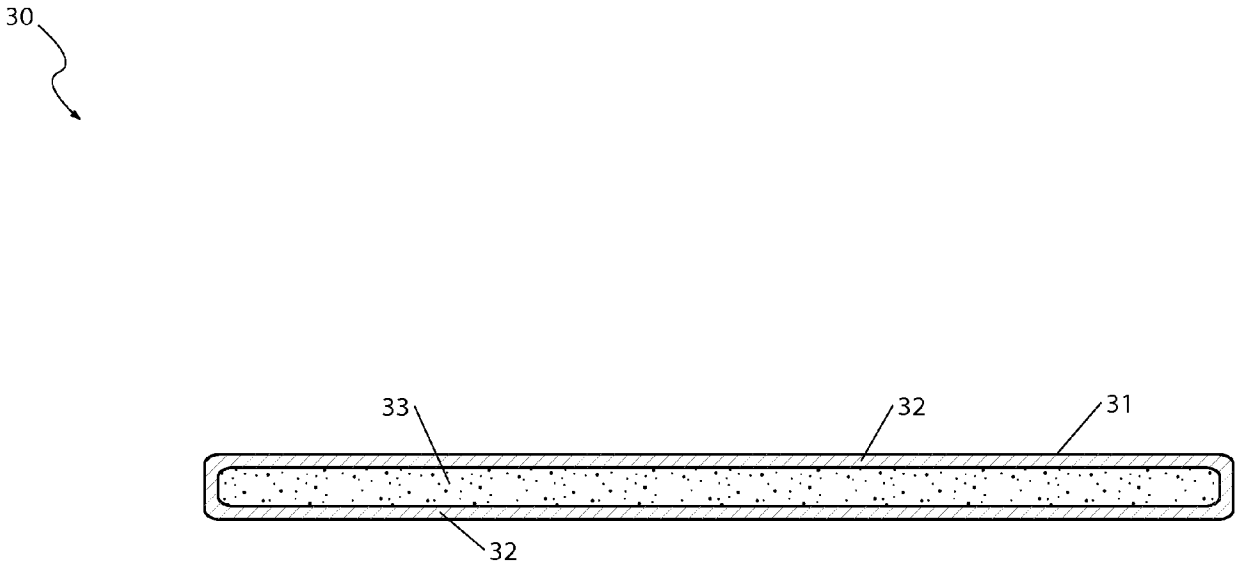
FIG. 3 is a cross-sectional view of the bottom half 30 of the water disc toy 10 taken along line A-A of FIG. 2, according to the preferred embodiment.

The best mode for carrying out the invention is presented in terms of its preferred embodiment, herein depicted within FIGS. 1 through 3 and in an alternate embodiment within FIGS. 4 through 7. However, the invention is not limited to the described embodiment, and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

FIG. 1 shows a perspective top view of the apparatus 10. The apparatus 10 is a manually propelled disc toy utilized in a manner similar to a common flying disc such as a FRISBEE®. The apparatus 10 is also of a buoyant waterproof construction specifically adapted for use in swimming pools and other wet recreational settings.

The apparatus 10 includes a top half 20 removably fastened to a bottom half 30. The top half 20 includes a top disc 21 and a plurality of columns 24. The top disc 21 is a generally flat structure and has a top shell 22 forming an exterior of the top disc 21. The top shell 22 is constructed of a buoyant, waterproof material. The top shell 22 is hollow and is filled with a buoyant foam material (see FIG. 3). In the preferred embodiment, the top disc 21 is a circular disc with a rounded perimeter edge, providing a radially symmetric and corner-less shaped that is well suited for throwing and catching in a manner similar to a common flying disc. In the preferred embodiment, the top shell 22 is constructed of a synthetic rubber providing a comfortable and secure grip and a waterproof construction.

The bottom half 30 includes a bottom disc 31 of similar construction to the top disc 21. The bottom disc 31 is a generally flat structure of the same size, shape, and material construction as the top disc 21 and has a bottom shell 32 constructed of the same material as the top shell 22. The bottom shell 32 is also hollow and contains a buoyant foam core 33 (see FIG. 3).

FIG. 2 shows a perspective bottom view of the apparatus 10 depicting the top half 20 separated from the bottom half 30. The plurality of columns 24 are affixed to a flat surface of the top disc 21 during manufacturing and extend outwardly perpendicularly from the surface of the top disc 21. The columns 24 provide mechanical connection and structural stability between the top half 20 and bottom half 30 during use. The columns 24 are preferably cylindrical in shape and constructed of the same material as the top shell 22. The columns 24 are preferably spaced radially about both the exterior and interior areas of the top disc 21.

Each column 24 includes a column fastener 27 at an end opposite the top disc 21. The column fasteners 27 provide detachable mechanical connection to a flat surface of the bottom disc 31. In the preferred embodiment, the column fasteners 27 are suction cups that provide a vacuum against the bottom shell 32, however other fasteners such as screws, slotted channels, male and female friction fit profiles, hook-and-loop type fasteners, or the like could be used with similar effect. The column fasteners 27 are engaged to the bottom half 30 prior to use, such that the top disc 21 is held in a parallel and aligned position relative to the bottom disc 31.

With the top half 20 and the bottom half 30 fastened together, a user can grip the apparatus 10 by one (1) or both discs 21, 31 and throw the apparatus 10 in a manner similar to a common flying disc. When thrown properly, the apparatus 10 will soar through the air in a controlled manner due to rotation of the discs 21, 31. The apparatus 10 can be skipped across a water surface and caught by another user. The buoyant construction of the discs 21, 31 and the columns 24 further ensures that the apparatus 10 will float if it comes to rest on a surface of a body of water, such as a swimming pool.

FIG. 3 shows a cross-sectional view of the bottom half 30 of the apparatus 10 taken along line A-A of FIG. 2. The line A-A is taken along a diameter of the bottom disc 31. The foam core 33 is of a congruent shape to the bottom shell 32 and is housed within the bottom shell 32. The foam core 33 is constructed of a lightweight foam material such as polyurethane foam, polystyrene foam, or the like. The foam core 33 reduces the overall weight and density of the apparatus 10 to increase safety and buoyancy.

The top disc 21 has a foam core (not shown) of identical geometric and material construction as the foam core 33 of the bottom disc 31.

Figure 4:
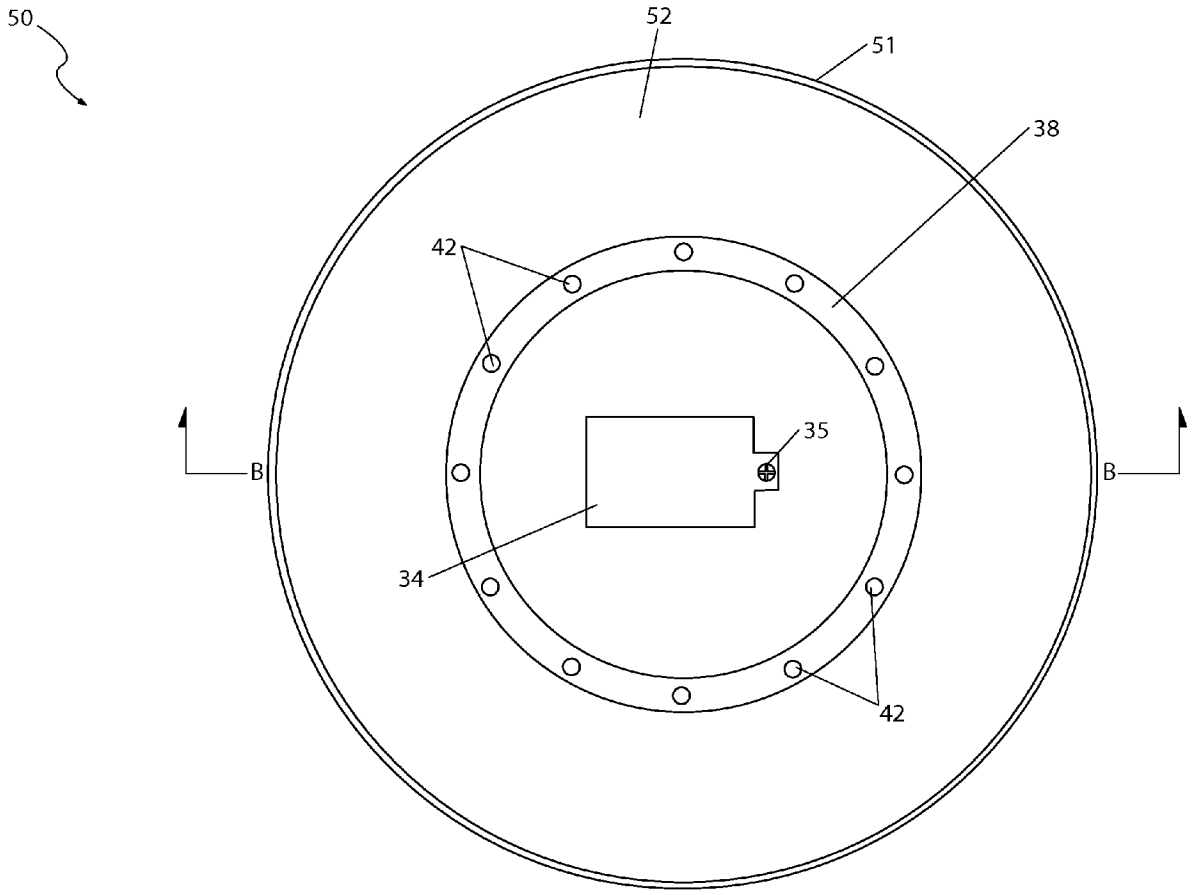
FIG. 4 is a top parallel view of the bottom half 30 of the water disc toy 10 with a plurality of light sources 42, according to an alternate embodiment.

FIG. 4 shows a top parallel view of an alternate bottom half 50 of the apparatus 10 including a plurality of light sources 42. In at least one (1) embodiment, the alternate bottom half 50 of the apparatus has a plurality of light sources 42 providing illumination to the apparatus 10 during use, wherein the plurality of light sources 42 are each a light-emitting diode.

The light sources 42 are powered by a battery 40 housed within a battery compartment 37. The battery compartment 37 is housed within an alternate bottom disc shell 52. The alternate bottom shell 52 has a battery cover 35 within a top surface. The battery cover 35 is removed to provide access to the battery compartment 37 that houses the battery 40. The battery cover 35 is constructed of the same material as the alternate bottom shell 52 and is removably fastened within the alternate bottom shell 52 with a cover fastener 35 such as a screw. There is a sealing member 36 affixed to the alternate bottom shell 52 between the battery cover 35 and the battery compartment 37 that prevents water or other liquids from entering the battery compartment 37 when the battery cover 35 is installed (see FIG. 7).

FIG. 4 further depicts the alternate bottom half 50 having a transparent or translucent surface 38 integrally formed within the alternate bottom shell 52. The transparent or translucent surface 38 covers the plurality of light sources 42 and allows light from those light sources 42 to escape and illuminate the apparatus 10. The transparent or translucent surface 38 is preferably formed from a transparent plastic material. The transparent or translucent surface 38 is affixed within the alternate bottom shell 52 during manufacturing with a process such as a compound molding process, a permanent adhesive, or an equivalent process. In an alternate embodiment, the transparent or translucent surface 38 is a circular ring centered within the top surface of the alternate bottom shell 52 and encompassing the battery cover 34.

Figure 5:
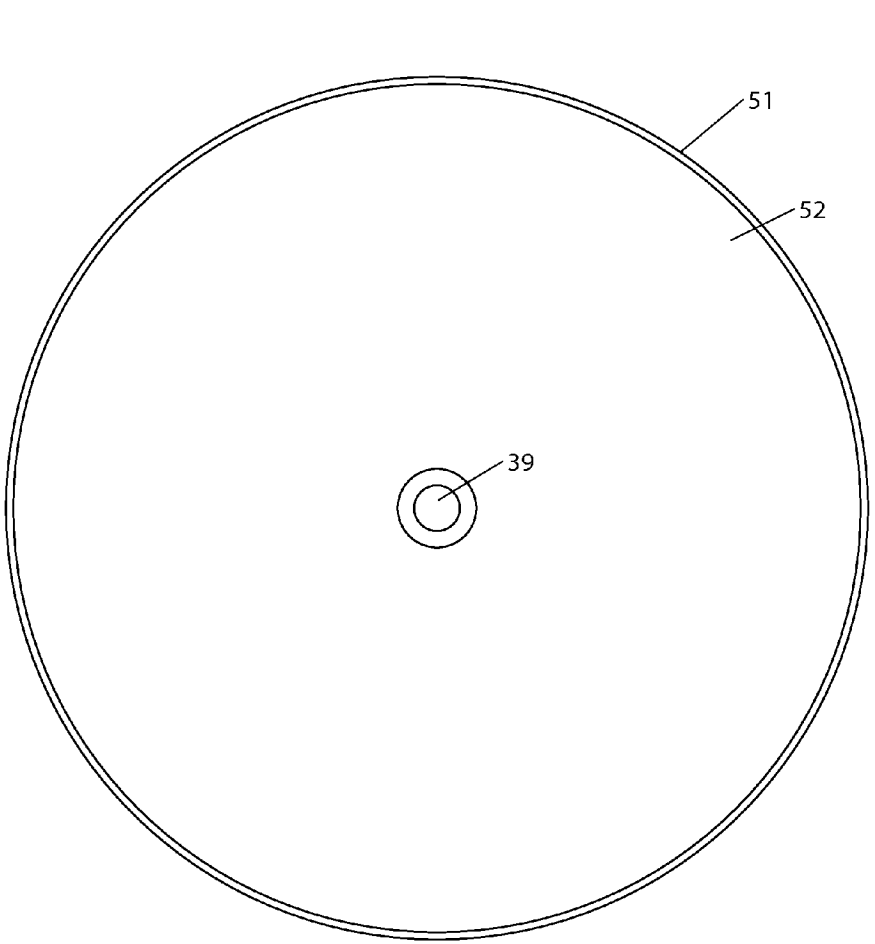
FIG. 5 is a bottom parallel view of the bottom half 30 of the water disc toy 10 with a plurality of light sources 42, according to the alternate embodiment.

FIG. 5 shows a bottom parallel view of the alternate bottom half 50 of the apparatus 10 including a plurality of light sources 42. A bottom surface of an alternate bottom disc 51 has a waterproof switch 39 that controls operation of the light sources 42. In the preferred embodiment, the switch 39 is a waterproof two (2) position push button located at a center position along the bottom surface of the alternate bottom shell 52. Examples of such waterproof push button constructions can be found with reference to U.S. Pat. No. 6,783,421 and other common commercial embodiments. The switch 39 alternates between an illuminated "ON" position and an unilluminated "OFF" position.

Figure 6:
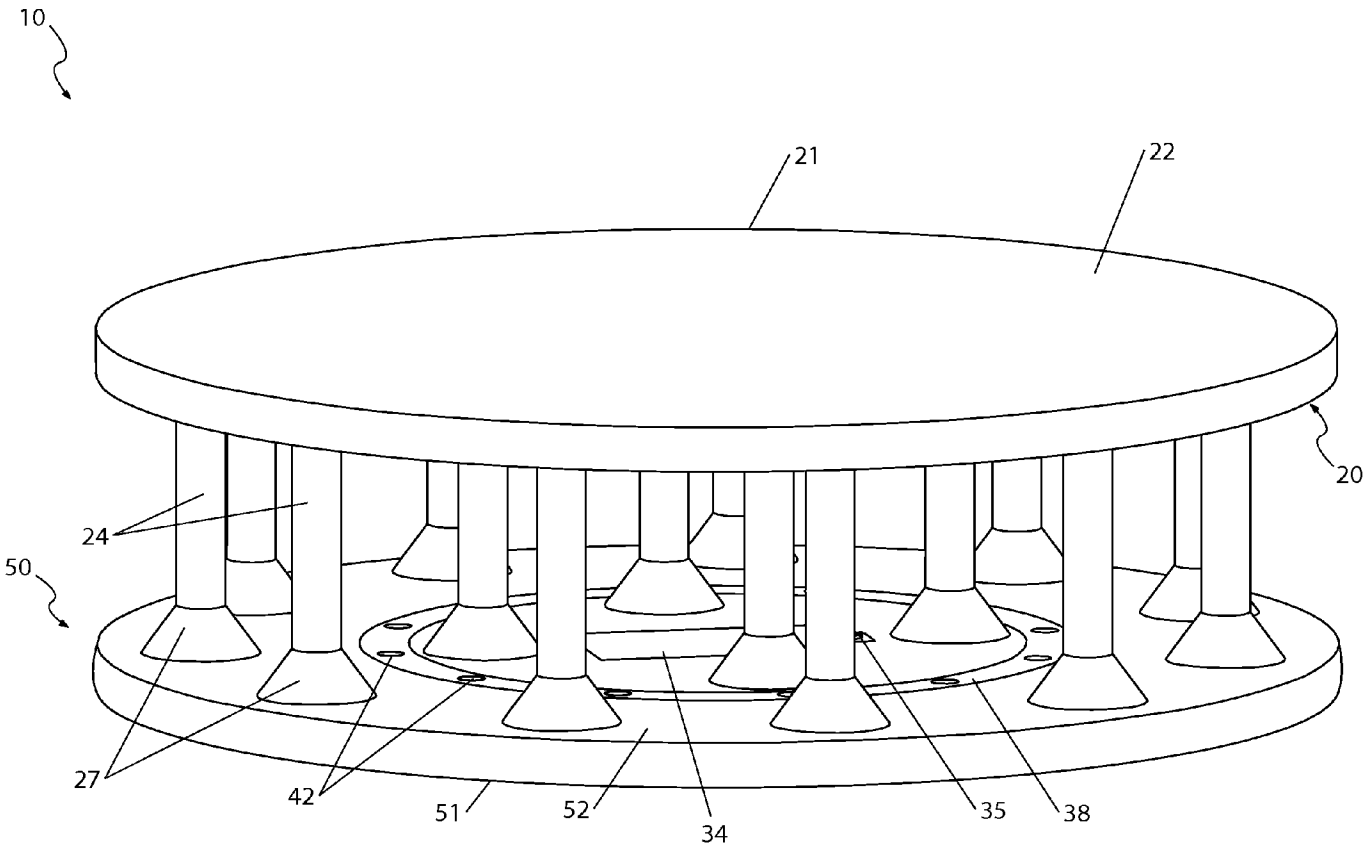
FIG. 6 is a perspective top view of the water disc toy 10 with a plurality of light sources 42, according to the alternate embodiment; and, FIG. 7 is a cross-sectional view of the bottom half 30 of the water disc toy 10 with a plurality of light sources 42 taken along line B-B of FIG. 4, according to the alternate embodiment.

FIG. 6 shows a perspective top view of the alternate embodiment of the apparatus 10 with a plurality of light sources 42. The columns 24 are preferably located in positions such that the column fasteners 27 do not cover the transparent or translucent surface 38 when installed.

The user can actuate the switch 39 in order to illuminate the light sources 42 and thus illuminate the space between the discs 21, 51. This provides additional visibility and entertaining aesthetic functions when utilizing the apparatus 10 in the dark. The waterproof construction of the battery cover 34 and the switch 39 ensures that the electrical components of the apparatus 10 with function continuously while the apparatus 10 is wet or even completely submerged.

Figure 7:
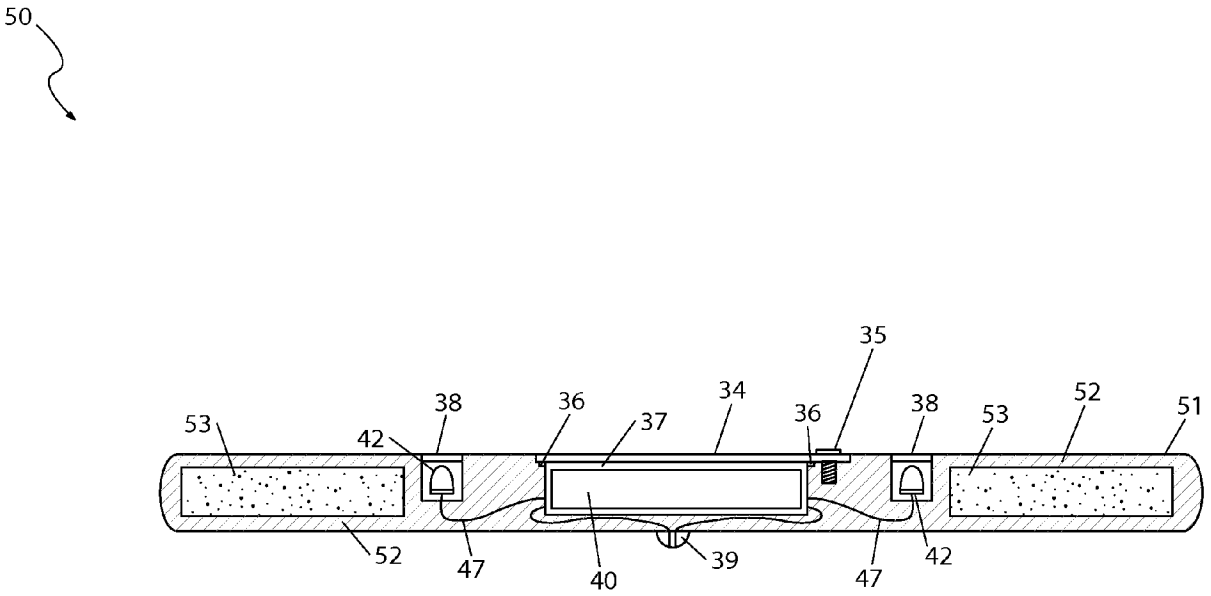

FIG. 7 shows a cross-sectional view of the alternate bottom half 50 of the apparatus 10 with a plurality of light sources 42 taken along line B-B of FIG. 4. The battery compartment 37 is a hollow area located directly underneath the battery cover 34 and within the alternate bottom disc 51. The battery compartment 37 receives a battery 40 to power the light sources 42. The sealing member 36 is preferably an elastomeric gasket that spans the entire perimeter of the battery compartment 37. When the battery 40 is installed, it is in electrical communication with the switch 39 via a length of insulated electrical wiring 47 installed within the alternate bottom disc 51 during manufacturing.

Each light source 42 is housed within the alternate bottom disc 51 directly beneath the transparent surface 38. The light source 42 is affixed within the alternate bottom disc 51 during manufacturing with an adhesive, a mechanical fastener, a geometric retaining means, or a similar method. Each light source 42 is in electrical communication with the battery 40 via a length of insulated electrical wiring 47 installed within the alternate bottom disc 51 during manufacturing.

The alternate foam core 53 has a circular aperture centered within the alternate bottom disc 51 and encompassing the battery compartment 37 and the plurality of light sources 42.

It is envisioned that other styles and configurations can be easily incorporated into the teachings of the present disclosure and only one particular configuration has been shown and described for purposes of clarity and disclosure and not by way of limitation of scope.

In accordance with the invention, the preferred embodiment can be utilized by the common user in a simple and effortless manner with little or no training. A user obtains a model of the apparatus 10 with a desired material construction, size, and shape. The user attaches the top half 20 to either flat surface of the bottom half 30 with the column fasteners 27, grips one (1) or both of the top and bottom discs 21, 31, and throws the apparatus 10 in a manner similar to a common flying disc for entertainment and exercise. Furthermore, the apparatus 10 can be utilized in water and will float on the surface of the water.

The user can detach the bottom half 30 from the top half 20 by unfastening the column fasteners 27. The user can then replace the bottom half 30 or install a bottom half 30 with a different aesthetic appearance or material construction.

A user can actuate the plurality of lights sources 42 of the alternate bottom half 50 with the switch 39 to illuminate the light sources 42 and provide a unique, aesthetic and highly visible appearance to the alternate embodiment of the apparatus 10. The user can utilize the apparatus 10 in water while the light sources 42 are illuminated. The user can detach the alternate bottom half 50 from the top half 20 in order to access the battery compartment 37 and battery 40 for removal, recharging, or replacement.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A toy, comprising:

a top half, comprising a planar structure;

a plurality of columns oriented parallel to each other, each comprising a first end extending outwardly from and affixed to an inner surface of said top half and terminating at a fastening means at a second end;

a bottom half removably fastened to said top half, comprising a planar structure coextensive with said top half;

wherein said top half and said bottom half further comprise a circular disc, comprising an outer shell layer and an inner layer encompassed by said outer shell layer and further comprising a rounded perimeter edge;

wherein said plurality of columns is spaced radially about and located on an interior and an exterior of said top half;

wherein said plurality of columns provides a stand-off for said bottom half relative to said top half when fastened thereto; and, wherein said fastening means provides a fastening connection for said top half to said bottom half.

2. The toy of claim 1, wherein said plurality of columns are each a cylindrical member.

3. The toy of claim 2, wherein said fastening means further comprises a suction cup.

4. The toy of claim 1, wherein said inner layer further comprises a buoyant foam core.

5. The toy of claim 4, wherein said plurality of columns are each a cylindrical member.

6. The toy of claim 5, wherein said fastening means further comprises a suction cup.

7. A toy, comprising:

a top half, comprising a planar structure;

a plurality of columns oriented parallel to each other, each comprising a first end extending outwardly from and affixed to an inner surface of said top half and terminating at a fastening means at a second end;

a bottom half removably fastened to said top half, comprising a planar structure coextensive with said top half; and, an illumination means disposed within said bottom half for providing illumination to said toy;

wherein said top half and said bottom half further comprise a circular disc, comprising an outer shell layer and an inner layer encompassed by said outer shell layer and further comprising a rounded perimeter edge;

wherein said plurality of columns is spaced radially about and located on an interior and an exterior of said top half;

wherein said bottom half further comprises an annular cavity for housing said illumination means;

wherein said bottom half further comprises a transparent or translucent annular cover for said annular cavity, thereby enabling said illumination to emanate therethrough;

wherein said plurality of columns provides a stand-off for said bottom half relative to said top half when fastened thereto; and, wherein said fastening means provides a fastening connection for said top half to said bottom half.

8. The toy of claim 7, wherein said plurality of columns are each a cylindrical member.

9. The toy of claim 8, wherein said fastening means further comprises a suction cup.

10. The toy of claim 9, wherein said illumination means further comprises:

a plurality of light sources disposed within said annular cavity;

a power switch in electrical communication with said plurality of light sources and mounted on an outer surface of said bottom half;

a power source in electrical communication with said power switch, housed within a compartment secured with a compartment cover located on an outer surface of said bottom half; and, a waterproof seal conformable between said compartment and said compartment cover.

11. The toy of claim 7, wherein said inner layer further comprises a buoyant foam core.

12. The toy of claim 11, wherein said plurality of columns are each a cylindrical member.

13. The toy of claim 12, wherein said fastening means further comprises a suction cup.

14. The toy of claim 13, wherein said illumination means further comprises:

a plurality of light sources disposed within said annular cavity;

a power switch in electrical communication with said plurality of light sources and mounted on an outer surface of said bottom half;

a power source in electrical communication with said power switch, housed within a compartment secured with a compartment cover located on an outer surface of said bottom half; and, a waterproof seal conformable between said compartment and said compartment cover.

* * * * *